US005491055A

United States Patent [19]

Kim

[11] Patent Number: 5,491,055

[45] Date of Patent: Feb. 13, 1996

[54] SILVER HALIDE PHOTOGRAPHIC EMULSIONS PREPARED AND SENSITIZED IN THE PRESENCE OF SULFODIHYDROXY ARYL COMPOUNDS

[75] Inventor: Sang H. Kim, Pittsford, N.Y.

[73] Assignee: Eastman Kodak Company, Rochester, N.Y.

[21] Appl. No.: 363,476

[22] Filed: Dec. 23, 1994

[51] Int. Cl.[6] ..... G03C 1/015; G03C 1/035; G03C 1/18

[52] U.S. Cl. ..... 430/567; 430/569; 430/588; 430/607

[58] Field of Search ..... 430/569, 588, 430/607, 567

[56] References Cited

U.S. PATENT DOCUMENTS

| | | | |
|---|---|---|---|
| 2,239,284 | 4/1941 | Draisbach | 95/7 |
| 3,236,652 | 2/1966 | Kannard et al. | 430/607 |
| 4,175,968 | 11/1979 | Credner et al. | 430/559 |
| 4,268,621 | 5/1981 | Ogi et al. | 430/409 |
| 4,713,317 | 12/1987 | Nakamura et al. | 430/551 |
| 4,741,990 | 5/1988 | Sakamoto et al. | 430/380 |
| 4,973,546 | 11/1990 | Kaneko et al. | 430/551 |
| 5,017,464 | 5/1991 | Nishijima et al. | 430/551 |
| 5,037,733 | 8/1991 | Goda | 430/584 |
| 5,049,473 | 9/1991 | Furuya et al. | 430/203 |
| 5,091,298 | 2/1992 | Parton et al. | 430/570 |
| 5,130,226 | 7/1992 | Sampei et al. | 430/264 |
| 5,219,721 | 6/1993 | Klaus et al. | 430/569 |
| 5,290,676 | 3/1994 | Nagaoka et al. | 430/588 |
| 5,294,532 | 3/1994 | Ito et al. | 430/588 |
| 5,330,887 | 7/1994 | Hasebe et al. | 430/588 |
| 5,340,711 | 8/1994 | Kim | 430/588 |

FOREIGN PATENT DOCUMENTS

| | | | |
|---|---|---|---|
| 339870 | 11/1989 | European Pat. Off. | 430/607 |
| 0566074 | 10/1993 | European Pat. Off. | G03C 1/07 |
| 623448 | 5/1949 | United Kingdom . | |
| 691715 | 5/1953 | United Kingdom . | |
| 904332 | 8/1962 | United Kingdom . | |

*Primary Examiner*—Janet C. Baxter
*Attorney, Agent, or Firm*—Paul A. Leipold

[57] ABSTRACT

The invention relates to an emulsion comprising silver halide grains said grains comprising sensitizing dyes adsorbed onto said grains during grain forming or sensitizing and at least one sulfodihydroxy aryl compound represented by the Fomulas I or II (Formula I)

(Formula II)

wherein

X and Y represent an $SO_3$ group or a hydrogen with at least one of X and Y being a sulfo group.

10 Claims, No Drawings

SILVER HALIDE PHOTOGRAPHIC EMULSIONS PREPARED AND SENSITIZED IN THE PRESENCE OF SULFODIHYDROXY ARYL COMPOUNDS

FIELD OF THE INVENTION

This present invention relates to light sensitive silver halide emulsions. In particular, it relates to light sensitive silver halide emulsions prepared and sensitized in the presence of sulfodihydroxy aryl compounds having low fog, high contrast, good speed, and wide sensitization plateau with robustness.

BACKGROUND OF THE INVENTION

Problems with fogging have plagued the phographic industry from its inception. Fog may be formed from a deposit of silver or dye that is not directly related to the image-forming exposure; i.e., when a developer acts upon an emulsion layer, some reduced silver is formed in areas that have not been exposed to light. % Fog can be used to measure the fog, which is (fogged silver/total silver coated)× 100.

It is known in the art that the appearance of fog can occur during many stages of preparation of the photographic element including silver halide precipitation, (spectro) chemical sensitization of the silver halide emulsion, melting and holding the liquid silver halide emulsion melts, and subsequent coating of silver halide emulsions. Such fog may occur due to trace amounts of metals such as iron, lead, tin, copper, nickel and the like from raw materials and manufacturing equipments.

Particularly, silver halide emulsions precipitated in the presence of ripeners such as thioethers or ammonia and/or reducing agents or environemts sensitive to reduction of silver ions such as high pH and/or low pAg usually suffer from high fog.

Several methods have been employed to minimize this appearance of fog as recently disclosed in U.S. Pat. No. 5,219,721 (1993) by R. Klaus et al and references therein. Klaus et al disclosed the use of organic dichalcogenides such as bis(p-acetamidophenyl)disulfide in sensitizing silver halide emulsions to combat fog. European Patent Application 0 566 074 A2 filed Apr. 14, 1993 by S. Kim et al disclosed use of such compounds in precipitation.

Research Disclosures 22534 (January, 1983) "Sensitized High Aspect Ratio Silver Halide Emulsions and Photographic Elements" and 308119 (December, 1989) "Photographic Silver Halide Emulsions, Preparation, Addenda, Processing and Systems" disclosed several methods which protect silver halide emulsions from fog and desensitization caused by metal contamination by incorporating addenda such as sulfocatechol-type compounds by Kenard et al U.S. Pat. No. 3,236,652; aldoximes by Carroll et al U.K. Patent 623,448; and meta- and poly-phosphates by Draisbach U.S. Pat. No. 2,239,284; and carboxyacids such as ethylenediamine tetraacetic acid by U.K. Patent 691,715. U.S. Pat. No. 3,300,312 by Willems et al disclosed use of sulfo-salicyclic acid type compounds to eliminate spot defects caused by metal contamination. U.S. Pat. No. 5,294,532—Ito et al discloses use of polyhydroxybenzene compounds for lowering fogging and improving pressure resistance.

Kenard et al U.S. Pat. No. 3,236,652 used sulfocatechol to eliminate desensitization and to prevent fogging caused by metal contamination by adding to the sensitized silver halide emulsions as a melt additive. It was not clear from the patent whether their emulsions contained optically sensitizing dyes or not. However, the use of optically (spectrally) sensitizing dyes during chemical sensitization was not readily known in the art until widespread use of tabular shaped silver halide emulsions.

PROBLEM TO BE SOLVED BY THE INVENTION

There is a continuing need for methods of improving fog characteristics of photographic silver halide emulsions.

SUMMARY OF THE INVENTION

This present invention provides an emulsion and the method of making the silver halide emulsion. The invention provides an emulsion comprising silver halide grains said grains comprising sensitizing dyes and adsorbed onto the grain during forming or finishing at least one sulfodihydroxy aryl compound represented by the Fomulas I or II

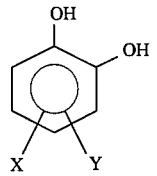

(Formula I)

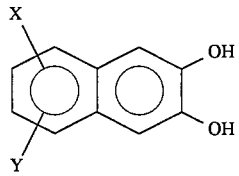

(Formula II)

wherein

X and Y represent an $SO_3$ group or a hydrogen with at least one of X and Y being a sulfo group.

The sulfo group is generally associated in a form of water soluble salts comprising alkali metals, preferably sodium, potassium, or ammonium.

ADVANTAGEOUS EFFECT OF THE INVENTION

This present invention provides light sensitive silver halide emulsions having low fog, high contrast, good speed (sensitivity), and wide sensitization plateau with robustness by incorporating sulfodihydroxy aryl compounds during formation of grains and/or before or during spectral and chemical sensitization (finishing) of silver halide emulsions. This invention is particularly useful in tabular silver bromoiodide grain formation and sensitization which are sensitive to fog formation during manufacture. This invention is further useful in sensitization of emulsions with certain dyes containing carboxy or carbamoyl substituents such as those disclosed in British Patent 904,332 and U.S. Pat. No. 5,091, 298. This invention may be extended to other silver halide emulsion sensitizations not in the examples such as blue spectral sensitization, non-tabular emulsions, and emulsions having halide compositions other than bromoiodide studied in the examples. This invention prevents fog formation from unexpected and/or intentional redox process or metal contamination during .emulsion manufacture.

DETAILED DESCRIPTION OF THE INVENTION

The sulfodihydroxy aryl compounds of this invention are represented by Formulas I or II:

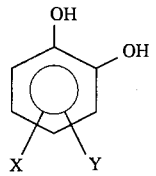

(Formula I)

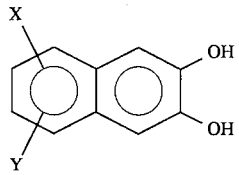

(Formula II)

In the above formula, X and Y represent a sulfo ($SO_3$) group or a hydrogen, with at least one of X and Y being a sulfo group. The sulfo group is generally in a form of water soluble salts comprising alkali metals such as sodium, potassium, and ammonium. Examples of prefered compounds include:

Compound I-1: 3,5-disulfo-catechol disodium salt or 4,5-dihydroxybenzene-1,3-disulfonic acid, disodium salt Compound I-2: 4-sulfocatechol ammonium salt Compound II-1: 2,3-dihydroxy-7-sulfonaphthalene sodium salt Compound II-2: 2,3-dihydroxy-6,7-disulfonaphthalene potassium salt The term "catechol" is equivalent to such commonly used terms as "pyrocatechol", "1,2-benzenediol", and "1,2-dihydroxybenzene".

The sulfodihydroxy aryl compounds of this invention can be prepared by various methods known to those skilled in the art such as those disclosed by Fukeyama et al in Japanese Patent 4327 ('52) and referenced in The Merck Index, p. 1219, Ninth Edition, 1976, by Merck & Co., Inc., N.J.

The optimal amount of the sulfodihydroxy aryl compounds to be added will depend on the desired final result, the type of emulsion, the degree of ripening, the structure of the sulfodihydroxy aryl compounds, and other variables. In general the concentration of sulfodihydroxy aryl compounds which is adequate is from about 0.0005 mole to about 0.5 mole per silver mole, with 0.001 mole to 0.3 mole per silver mole being preferred. The most preferred range is 0.003 mole to 0.02 mole per silver mole because of optimum low fog, without significant speed loss.

A method of the invention may be performed utilizing any suitable sensitizing temperature. Typical temperatures are between about 40° and 80° C. A preferred temperature has been found to be between about 60° and about 75° C. for best sensitization and low time of heat digestion (sensitization) times. The sensitization time may be any suitable amount. Typical sensitization times during which the material is at the highest temperature of the cycle is between about 1 and about 30 minutes. A preferred time is between about 5 and 20 minutes for best sensitization and lower cost of sensitization, as the cycle time is reasonably short.

Combinations of the sulfodihydroxy aryl compounds may be used. The sulfodihydroxy aryl compounds also may be added in combination with other antifoggants, stabilizers, and finish modifiers such as disclosed in Research Disclosure 308119 (December 1989).

The method of this invention is particularly useful with intentionally or unintentionally reduction sensitized emulsions. As described in *The Theory of the Photographic Process,* 4th edition, T. H. James, Macmillan Publishing Company, Inc., 1977, pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion).

During precipitation of a silver halide emulsion, unintentional reduction sensitization can occur when silver nitrate or alkali solutions are added rapidly or with poor mixing to form emulsion grains, for example. Also silver halide emulsions precipitated in the presence of ripeners (grain growth modifiers) such as thioethers, selenoethers, thioureas, or ammonia tend to facilitate reduction sensitization.

The reduction sensitized silver halide emulsions prepared as described in this invention exhibit good photographic speed but usually suffer from undesirable fog and poor storage stability.

Examples of reduction sensitizers and environments which may be used during precipitation or spectrochemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979).

Examples of processes for preparing intentionally reduction sensitized silver halide emulsions are described in EP 0 348934 A1 (Yamashita), EP 0 369491 (Yamashita), EP 0 371388 (Ohashi,), EP 0 396424 A1 (Takada), EP 0 404142 A1 (Yamada) and EP 0 435355 A1 (Makino).

In accordance of this invention, it has been found that the addition of sulfodihydroxy aryl compounds to a silver halide emulsion during precipitation and/or spectro-chemical sensitization gives lower fog without concomitant loss in sensitivity than when added after sensitization as taught by the prior art. Powerful antifogging activity of the sulfodihydroxy aryl compounds of the invention was unexpected when compared to a known antifoggant, disulfide disclosed in U.S. Pat. No. 5,219,721. Careful reading of the prior arts did not suggest to utilize sulfodihydroxy aryl compounds during formation of silver halide grains and/or before or during spectro-chemical sensitization of tabular silver bromoiodide emulsions.

The silver halide emulsion of the invention preferably is a tabular silver bromoiodide emulsion chemically sensitized in the presence of spectral sensitizing dyes. The method of this invention is also particularly useful with emulsions doped with Group VIII metals such as iridium, rhodium, osmium and iron as described in *Research Disclosure*, December 1989, Item 308119, published by Kenneth Mason Publications, Ltd., Dudley Annex, 12a North Street, Emswirth, Hampshire P010 7DQ, ENGLAND. It is common practice in the art to dope emulsions with these metals for reciprocity control.

A general summary of the use of iridium in the sensitization of silver halide emulsions is contained in Carroll, "Iridium Sensitization: A Literature Review," Photographic Science and Engineering, Vol. 24, No. 6, 1980.

A method of manufacturing a silver halide emulsion by chemically sensitizing the emulsion in the presence of an iridium salt and a photographic spectral sensitizing dye is described in U.S. Pat. No. 4,693,965. The low intensity reciprocity failure characteristics of a silver halide emulsion may be improved, without significant reduction of high intensity speed, by incorporating iridium ion into the silver halide grains after or toward the end of the precipitation of the grains is described in U.S. Pat. No. 4,997,751 (Kim). The use of osmium in precipitating an emulsion is described in U.S. Pat. No. 4,933,272 (McDugle).

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

In one preferred embodiment, the silver halide emulsion is a tabular silver bromoiodide emulsion chemically sensitized in the presence of spectral sensitizing dyes. In other embodiments, the silver halide emulsion may be a reduction sensitized or a doped emulsion.

The sulfodihydroxy aryl compounds, if added during emulsion formation, may be present or be added during the combination of silver and halide to form an emulsion. The compounds may be added to the halide salt stream, or they may be present in the kettle used for formation of the emulsion when the kettle initially contains a halide salt solution. However, it has been found that addition of the sulfodihydroxy aryl compounds to the feed stream containing the silver ion, typically a silver nitrate solution does not yield the suitable emulsions.

The following examples are intended to illustrate, without limiting, this invention. The following compounds are utilized in the examples.

Compound I-1: 3,5-disulfo-catechol disodium salt

Compound A: 2,4 dihydroxybenzoic acid

Compound B: 2,5 dihydroxybenzoic acid or gentistic acid

Compound C: 2,5 dihydroxy-p-benzene disulfonic acid dipotassium salt

Compound D: 2,5 dihydroxybenzene sulfonic acid potassium salt

Compound E: 3,4,5-trihydroxy-benzoic acid or gallic acid

Compound F: 5-sulfosalicylic acid, 2-hydrate

Compound G: P-acetamidophenyl disulfide

Compound H: 4-hydroxy-6-methyl-1,3,3a,7-tetraazaindene

Compound I: 3-(2-methylsulfamoyl)-benzothiazolium tetrafluoroborate

Compound J: sodium thiosulfate pentahydrate

Compound K: sodium aurous(I) dithiosulfate dihydrate

Compound L: ethylene diamine tetraacetic acid sodium salt (EDTA)

Compound M: 1,3-diamino-2-propanol tetraacetic acid (DPTA)

Compound N: acetoamidophenyl mercaptotetrazole

Sensitizing Dye A

Sensitizing Dye B
Sensitizing Dye C
Sensitizing Dye D
Sensitizing Dye E
Sensitizing Dye F
Coupler A
Coupler B
Coupler C
(See Appendix for structures of dyes and couplers)

EXAMPLE 1

In Sensitization vs. Melt

An iridium doped 0.77 μm×0.11 thick 3% I silver bromoiodide tabular emulsion (Emulsion A) was sensitized by adding 100 mg NaCNS, 1.0 mmole Sensitizing Dye A, 0.3 mmole Sensitizing Dye B, 3.73 mg Compound K, 2.46 mg Compound J and 35 mg Compound I per Ag mole followed by digestion at 66° C. for 10 min. 0.0181 or 0.181 mole Compound I-1 per Ag mole was added before adding chemical sensitizers during the sensitization or in the melt as shown in Table 1 below. Sensitized emulsions were coated at 0.65 g/sq. m. level after melting with 1.75 g Compound H/mole silver, 1.9 g/sq. m. Couplers A and B (30:70 ratio) and gelatin (2.4 g/sq. m.) at 40° C. over antihalation cellulose acetate support followed by a 2.2 g/sq. m. gelatin overcoat with sufactant and hardner.

The coatings were exposed to 5500K with Kodak Wratten 9 filter and processed for 4 min. in E6 process (*British Journal of Photography Annual*, 1982, pp. 201–203). Relative speed was measured at a density of 0.3 below maximum density (Dmax) and was expressed in multiplied by 100. Gamma is a contrast at 1.0 density. % Fog was determined by (minimum density/maximum density)×100 from a process which developed the emulsion coatings to form a negative black and white image for 4 minutes, followed by forming a negative color image. Photographic test results are summarized below.

TABLE 1

| Sample No. | Compound I-1 Added in | % Fog | Dmax | Gamma | Speed |
|---|---|---|---|---|---|
| 1 comparison | none | 53.1 | 1.05 | −27 | 181 |
| 2 comparison | melt | 51.9 | 1.09 | −48 | 185 |
| 3 invention | sensitization (1) | 6.7 | 2.16 | −229 | 202 |
| 4 invention | sensitization (2) | 6.0 | 2.17 | −241 | 198 |

(1) 0.0181 mmole/mole Ag
(2) 0.181 mmole/mole Ag

The sample 2 being prepared according to Kennard et al U.S. Pat. No. 3,236,652 provided very small reduction in fog. Unexpectedly, addition of the Compound I-1 in the sensitization removed the fog nearly completely and provided optimum speed and contrast of the emulsion.

EXAMPLE 2

In Sensitization vs. Melt with and Without Antifogging Compound

Samples similar to those in Example 1 were prepared except that antifogging Compound G was added at 2.5 mg/Ag mole as taught by Klaus et al U.S. Pat. No. 5,219,721. Test results are summarized in Table 2.

TABLE 2

| Sample No. | Added in Sensitization: Compound I-1 | Compound G | % Fog | Dmax | Gamma | Speed |
|---|---|---|---|---|---|---|
| 1 comparison | none | none | 53.1 | 1.05 | −27 | 181 |
| 5 comparison | none | yes | 57.7 | .93 | −1 | 179 |
| 6 comparison | in melt | yes | 34.0 | 1.52 | −153 | 198 |
| 3 invention | yes | none | 6.7 | 2.16 | −229 | 202 |
| 7 invention | yes | yes | 6.2 | 2.22 | −241 | 202 |
| 8 invention | yes/in melt | yes | 6.2 | 2.19 | −240 | 200 |

The sample 5 was not better than the comparative sample 1. It was further improved by combining both teachings of Kenard and Klaus as shown by the sample 6. However the Compound I-1 was most effective when added during the sensitization. It was further improved in the presence of the antifogging Compound G. The inventive sample 8 indicated that additional Compound I-1 in melt provided no further improvement in this case.

EXAMPLE 3

In Precipitation

Iridium doped 3 mole%I silver bromoiodide emulsions similar to Emulsion A were prepared by the following basic procedure:

Preparation of Emulsion B

A 3.0% I silver bromoiodide tabular emulsion was precipitated by a double jet procedure. The following procedure produced 1 mole of total silver precipitation: 0.01 moles of silver was introduced for 1 min. by 1.2N AgNO3 with salt solution A (1.164N NaBr and 0.036N KI) to a vessel filled with 860 cc aqueous solution containing 0.6 g deionized bone gel, 0.9 g NaBr and 0.07 g 1,8-dihydroxy-1,3-dithioactane at pH 3.5 and 30° C. After holding for 6 min., vessel temperature was raised to 50° C. Vessel pH was adjusted to 4.5 after adding 17 g deionized oxidized gelatin. Emulsion grains were grown to the aim size for 68 min. by adding 2.5N AgN03 and salt solution B (2.425N NaBr and 0.075N KI) with gradually increasing flow rates while maintaining pAg at 8.9. 0.1 mg/Ag mole of K2IrCl6 was added after 90% of total silver precititation. The resultant emulsion was washed by an ultrafiltration technique, and pH and pAg were adjusted to 5.7 and 8.2 at 40° C. respectively.

Emulsion C was prepared exactly like Emulsion B except adding 0.0181 mole/Ag mole of Compound I-1 into washed emulsion followed by pH and pAg adjustment.

Emulsion D was prepared exactly like Emulsion B except adding 0.0181 mole/total Ag mole Compound I-1 to the vessel before nucleation.

Emulsion E was prepared exactly like Emulsion B except using AgN03 solutions containing 0.0181 mole/Ag mole Compound I-1.

Emulsion F was prepared exactly like Emulsion B except using salt solutions containing 0.0181 mole/Ag mole Compound I-1.

Median area-weighted grain size of these tabular emulsions was about 0.55 μm with about 22% coefficient of variation. Their mean thickness was estimated to be about 0.12 μm. No significant physical change was observed by incorporating Compound I-1 in the precipitation.

These emulsions were sensitized by adding 2.5 mg Compound G, 100 mg NaCNS, 1.1 mmole Sensitizing Dye A, 0.35 mmole Sensitizing Dye B, 4.22 mg Compound K, 2.78 mg Compound J, and 35 mg Compound I per Ag mole followed by digestion at 68° C. for 10 min. Duplicate sensitizations were done and photographic tests similar to Example 1 were performed. Average data are summarized in Table 3. 0.0181 mole of Compound I-1 was added to all emulsion melts as melt additive. Similar results were obtained by digesting at 72° C. instead of 68° C.

TABLE 3

| Sample No. | Emulsion ID | Compound I-1 Added* | % Fog | Speed |
|---|---|---|---|---|
| 9 comparison | Emulsion B | None | 10.7 | 202 |
| 10 invention | Emulsion B | Sensitization (.0065) | 2.1 | 203 |
| 11 invention | Emulsion B | Sensitization (.0181) | 2,9 | 198 |
| 12 invention | Emulsion C | After wash (.0181) | 2.1 | 195 |
| 13 invention | Emulsion D | In vessel (.0181) | 3.3 | 201 |
| 14 comparison | Emulsion E | In AgNO3 (.0181) | 86.0 | nm# |
| 15 invention | Emulsion F | In Salt (.0181) | 3.8 | 203 |

*Indicated where the Compound I-1 was added with amount in parenthesis
# not measurable The fog of the comparison Emulsion B was reduced by the Compound I-1 in sensitization as shown by the Example 2. Increasing the amount of the Compound I-1 there was a slight reduction in speed. Instead of adding the Compound I-1 before chemical sensitizers, it was added right after washing followed by sensitization (Sample 12), which provided results similar to Sample 11. Addition of the Compound I-1 in vessel before nucleation or in salt solutions for nucleation and growth provided results similar to the Samples 10, 13, and 15. Nucleating and growing silver halide grains by silver nitrate containing the Compound I-1 produced unacceptably high fog and too low reversal densities to measure speed. These examples demonstrate usefulness of the Compound I-1 as antifoggant in precipitation and/or in sensitization. Samples similar to 13 and 15 were also prepared except that additional 0.0065 mole of the Compound I-1 was added in the sensitization, which provided only small additional fog reduction because the level of the fog was already at the minimum.

EXAMPLE 4

Comparative Compounds

Emulsion A was sensitized like Example 1 except Sensitizing Dye B was used in place of Sensitizing Dye A. Prior to chemical sensitizer addition, various comparative compounds were added and tested similarly to Example 3. Results are summarized in Table 4. Two samples for each compounds were prepared with and without 0.0181 mole/Ag mole Compound I-1 as melt additive.

TABLE 4

| Sample No. | Compound* | Compound I-1 in Melt | % Fog | Dmax | Gamma# | Speed# |
|---|---|---|---|---|---|---|
| 16 comparison | none | yes | 44.6 | 1.28 | −95 | 189 |
| 17 comparison | none | no | 50.0 | 1.21 | −83 | 187 |
| 18 invention | I-1 | yes | 5.8 | 2.26 | −221 | 197 |
| 19 invention | I-1 | no | 5.3 | 2.30 | −205 | 200 |
| 20 comparison | A | yes | 71.6 | 0.64 | nm | 162 |

TABLE 4-continued

| Sample No. | Compound* | Compound I-1 in Melt | % Fog | Dmax | Gamma# | Speed# |
|---|---|---|---|---|---|---|
| 21 comparison | A | no | 69.4 | 0.69 | nm | 164 |
| 22 comparison | B | yes | 100 | 0.04 | nm | nm |
| 23 comparison | B | no | 100 | 0.04 | nm | nm |
| 24 comparison | C | yes | 100 | 0.04 | nm | nm |
| 25 comparison | C | no | 100 | 0.04 | nm | nm |
| 26 comparison | D | yes | 100 | 0.04 | nm | nm |
| 27 comparison | D | no | 100 | 0.04 | nm | nm |
| 28 comparison | E | yes | 100 | 0.04 | nm | nm |
| 29 comparison | E | no | 100 | 0.04 | nm | nm |
| 30 comparison | F | yes | 13.8 | 2.08 | −165 | 189 |
| 31 comparison | F | no | 20.2 | 1.89 | −153 | 186 |

*0.0181 mole/Ag mole
#nm = not measureable due to very high fog(low Dmax)

The inventive Compound I-1 provided the highest Dmax, contrast and speed at the lowest fog. The Compounds A→E acted as fogging agent instead of antifoggant. Mostly their samples were totally fogged and no reversal images were observed. The Compound F disclosed in U.S. Pat. No. 3,300,312 by Willems et al was close to the inventive sample but still unacceptably high fog, low contrast, and low speed.

EXAMPLE 5

Other Comparative Sequestrants

Other metal ion sequestrants disclosed in the prior arts were also tested as comparative examples: Compounds L and M disclosed in U.K. Patent 691,715. Samples were sensitized similar to Example 2 using Emulsion A and coated and tested similar to Example 1. Compound I-1 (0.0181 mole/Ag mole) was added as melt additive. Results are summarized in Table 5. The inventive sample showed results similar to the comparative samples.

TABLE 5

| Sample No. | Compound ID* | % Fog | Dmax | Gamma | Speed |
|---|---|---|---|---|---|
| 32 comparison | none | 21.3 | 1.81 | −180 | 207 |
| 33 invention | I-I | 4.9 | 2.12 | −231 | 203 |
| 34 comparison | M | 4.3 | 2.16 | −235 | 201 |
| 35 comparison | N | 3.5 | 2.20 | −234 | 206 |

*0.0091 mole/Ag mole was added in sensitization

EXAMPLE 6

Green Sensitizing Dyes and Their Combinations

Experiments were performed like Examples 1 and 2 on Emulsion A which was sensitized with Compound G, and with and without 0.0181 mole/Ag mole Compound I-1. Digestion temperature was 68° C. Included in the melt was 0.0168 mole Compound I-1/Ag mole. Results are summarized in Table 6.

TABLE 6

| Sample No. | Sensitizing Dyes # | Compound I-1* | % Fog | Dmax | Gamma | Speed |
|---|---|---|---|---|---|---|
| 36 comparison | 1.0 A + .3 B | no | 11.8 | 2.03 | −206 | 203 |
| 37 invention | 1.0 A + .3 B | yes | 3.3 | 2.24 | −235 | 195 |
| 38 comparison | 1.3 A | no | 2.6 | 2.24 | −248 | 185 |
| 39 invention | 1.3 A | yes | 2.1 | 2.28 | −248 | 185 |
| 40 comparison | 1.3 B | no | 79.4 | 0.47 | −2 | 150 |
| 41 invention | 1.3 B | yes | 8.0 | 2.07 | −215 | 204 |

*In sensitization
# mmole dyes/Ag mole

Magnitude of the fog reduction by the Compound I-1 depended on kinds of sensitizing dyes. It was most effective when the Sensitizing Dye B was present. This suggested that it was particularly useful for carboxy substituted dyes. Similar observation was made when other melt stabilizer such as Compound N in addition to Compound H.

EXAMPLE 7

Other Green Sensitizing Dyes and Their Combinations

Studies similar to Example 6 were performed with other sensitizing dyes.

Except for the Sample 53 (Sensitizing Dye C), fog reduction was evident when the Compound I-1 was present in sensitization. As was seen in the Example 6, magnitude of the fog reduction depended on kinds of sensitizing dyes. It was most effective when the Sensitizing Dye B and D were present. This suggested that it was particularly useful for carboxy or carbamoyl substituted dyes such as those disclosed in U.S. Pat. No. 5,091,298 and British Patent 904, 332. Results are summarized in Table 7.

TABLE 7

| Sample No. | Sensitizing Dyes # | Compound I-1* | % Fog | Dmax | Gamma | Speed |
|---|---|---|---|---|---|---|
| 42 comparison | 1.0 A + .3 B | no | 9.6 | 2.00 | −196 | 203 |
| 43 invention | 1.0 A + .3 B | yes | 7.5 | 2.06 | −213 | 200 |
| 44 comparison | 1.0 A + .3 D | no | 19.1 | 1.88 | −166 | 199 |
| 45 invention | 1.0 A + .3 D | yes | 10.8 | 2.02 | −189 | 195 |
| 46 comparison | 1.0 A + .3 C | no | 3.8 | 2.25 | −200 | 157 |
| 47 invention | 1.0 A + .3 C | yes | 3.4 | 2.20 | −187 | 163 |
| 48 comparison | 1.3 B | no | 40.6 | 1.34 | −114 | 197 |
| 49 invention | 1.3 B | yes | 9.5 | 2.07 | −189 | 207 |
| 50 comparison | 1.3 D | no | 13.5 | 2.00 | −170 | 184 |
| 51 invention | 1.3 D | yes | 7.6 | 2.11 | −199 | 181 |
| 52 comparison | 1.3 C | no | 13.0 | 2.33 | −62 | 35 |
| 53 comparison | 1.3 C | yes | 14.0 | 2.34 | −63 | 29 |

*In sensitization
# mmole dyes/Ag mole

EXAMPLE 8

Robust Sensitization

An iridium doped 0.3 μm×0.064 μm thick 6% I silver bromoiodide tabular emulsion was sensitized by adding 2 mg Compound G, 200 mg NaCNS, 1.33 mmole Sensitizing Dye A, 0.39 mmole Sensitizing Dye B, 9.54 mg Compound K, 6.27 mg Compound J, and 35 mg Compound I per Ag mole followed by digestion at various temperatures for 10 min. 0.0181 mole Compound I-1 per Ag mole was added before adding chemical sensitizers for demonstrating this invention but was not added in the melt. Other experiments were performed as described in the Example 1.

TABLE 8

| Sample No. | Compound I-1 | Digestion Temperature | % Fog | Dmax | Gamma | Speed |
|---|---|---|---|---|---|---|
| 54 comparison | no | 66° C. | 8.0 | 2.38 | −236 | 148 |
| 55 comparison | no | 69° C. | 9.4 | 2.38 | −240 | 154 |
| 56 comparison | no | 72° C. | 13.4 | 2.34 | −238 | 160 |
| 57 invention | yes | 66° C. | 3.1 | 2.48 | −309 | 150 |
| 58 invention | yes | 68° C. | 4.0* | 2.46* | −275* | 154* |
| 59 invention | yes | 72° C. | 6.8 | 2.42 | −264 | 153 |

*Optimum response

As shown in Table 8, the optimum speed was obtained at lower fog with higher contrast and wider speed and fog plateau when the Compound I-1 was incorporated in the sensitization.

EXAMPLE 9

Red Sensitizing Dyes and Robust Sensitization

An iridium doped 0.75 μm×0.107 μm thick 3% I silver bromoiodide tabular emulsion similar to Emulsion A except the iodide content was sensitized by adding 2 mg Compound G, 200 mg NaCNS, 0.86 mmole Sensitizing Dye E, 0.10 mmole Sensitizing Dye F, 6.4 mg Compound K, 4.2 mg Compound J, and 35 mg Compound I per Ag mole followed by digestion at various temperatures for 10 min. 0.0181 mole Compound I-1 per Ag mole was added before adding chemical sensitizers for demonstrating this invention, but was not added in the melt. Other tests in this example were performed as described in the Example 1 except that the sensitized emulsions were coated at 0.82 g/sq. m. level with 3.5 g Compound H/mole silver and 1.6 g/sq. m. Coupler C and the coatings were exposed with Kodak Wratten 23A filter. Results are shown in Table 9.

TABLE 9

| Sample No. | Compound I-1 | Temperature | % Fog | Dmax | Gamma | Speed |
|---|---|---|---|---|---|---|
| 60 comparison | no | 64° C. | 18.4 | 1.90 | −173 | 191 |
| 61 comparison | no | 68° C. | 14.5 | 1.96 | −181 | 194 |
| 62 comparison | no | 72° C. | 15.5 | 1.93 | −186 | 190 |

TABLE 9-continued

| Sample No. | Compound I-1 | Temperature | % Fog | Dmax | Gamma | Speed |
|---|---|---|---|---|---|---|
| 63 comparison | no | 76° C. | 19.7 | 1.85 | −171 | 181 |
| 64 invention | yes | 64° C. | 7.7 | 2.13 | −188 | 189 |
| 65 invention | yes | 68° C. | 8.7* | 2.06* | −204* | 192* |
| 66 invention | yes | 72° C. | 12.7 | 1.97 | −188 | 190 |
| 67 invention | yes | 76° C. | 12.9 | 1.97 | −184 | 189 |

*Optimum response

As shown in Table 9, the Compound I-1 was also effective in the sensitization containing red spectral sensitizing dyes and provided optimum speed at lower fog with higher contrast and wider speed and fog plateau.

APPENDIX

Sensitizing Dye A

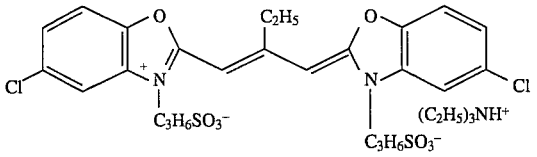

Sensitizing Dye B

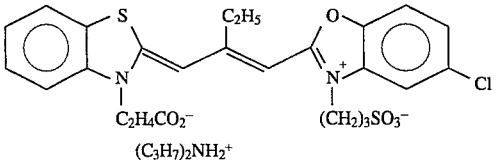

Sensitizing Dye C

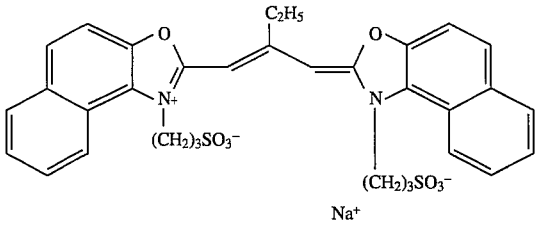

Sensitizing Dye D

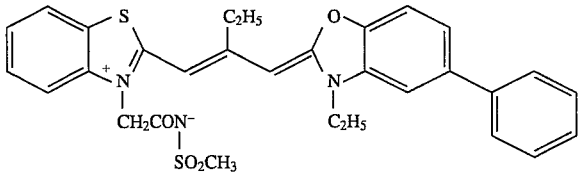

Sensitizing Dye E

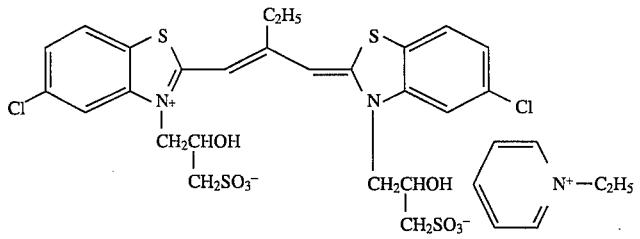

-continued

APPENDIX

Sensitizing Dye F

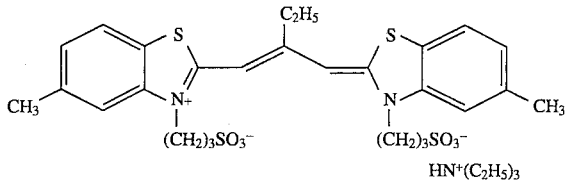

Coupler A

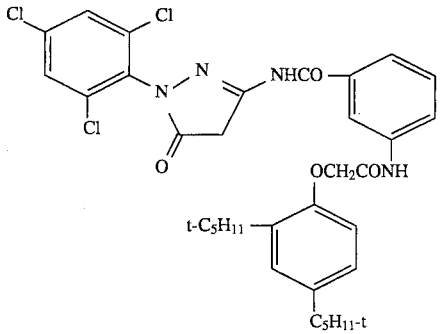

Coupler B

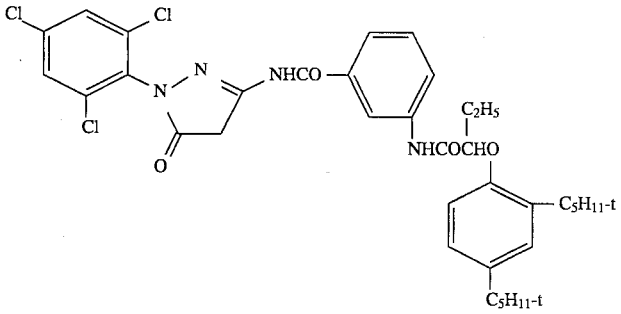

Coupler C

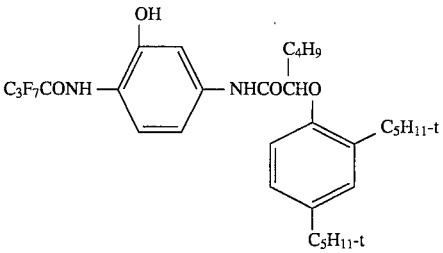

The invention has been described in detail with particular reference to preferred embodiments thereof, but it will be understood that variations and modifications can be effected within the spirit and scope of the invention.

I claim:

1. An emulsion comprising tabular silver bromoiodide grains said grains comprising sensitizing dyes and adsorbed onto said grains during grain forming or sensitizing at least one sulfodihydroxy aryl compound represented by the Formula I or Formula II

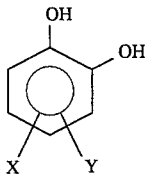

(Formula I)

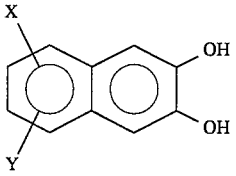

(Formula II)

wherein

X and Y represent an $SO_3$ group or a hydrogen atom with at least one of X and Y being a sulfo group wherein said dyes and sulfodihydroxy aryl compound are on the surface of said grains and said sensitizing dyes comprise carboxy or carbamoyl substituents.

2. The emulsion of claim 1 wherein said sulfodihydroxy aryl compound comprises at least one of Compound I-1: 3,5-disulfo-catechol disodium salt or 4,5-dihydroxy benzene-1,3-disulfonic acid disodium salt Compound I-2: 4-sulfocatechol ammonium salt Compound II-1: 2,3-dihydroxy-7-sulfonaphthalene sodium salt, and Compound II-2: 2,3-dihydroxy-6,7-disulfonaphthalene potassium salt.

3. The emulsion of claim 1 wherein at least one of said dyes is selected from the group consisting of

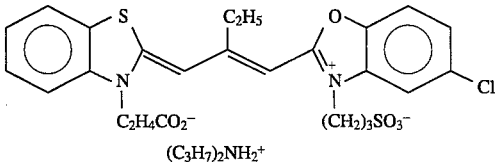

and

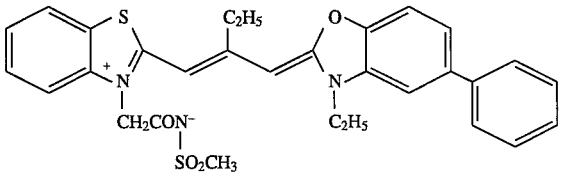

4. A method comprising forming a tabular silver bromoiodide emulsion, washing said emulsion, and sensitizing said emulsion by adding dyes and chemical sensitizers, and heating, wherein a sulfodihydroxy aryl compound is added to said emulsion during forming or sensitizing and said sulfodihydroxy aryl compound comprises a sulfodihydroxy aryl compound represented by the Formula I or Formula II

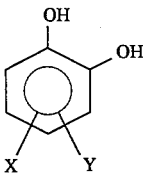

(Formula I)

-continued

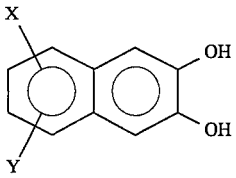

(Formula II)

wherein

X and Y represent an $SO_3$ group or a hydrogen atom with at least one of X and Y being a sulfo group, wherein said sulfodihydroxy aryl compound is added during forming said emulsion and is not added to a silver nitrate stream, wherein said dyes and sulfodihydroxy aryl compound are on the surface of said grains and said sensitizing dyes comprise carboxy or carbamoyl substituents.

5. The method of claim 4 wherein said sulfodihydroxy aryl compound is added in an amount of between 0.0005 and 0.5 mole per mole of silver.

6. The method of claim 4 wherein said sulfodihydroxy aryl compound is added in an amount of between 0.003 and 0.02 mole per mole of silver.

7. The method of claim 4 wherein said emulsion is sensitized at a temperature between about 60° and 75° C.

8. A method of claim 7 wherein said sensitizing is carried out for between about 5 and about 20 minutes at the sensitizing temperature.

9. The method of claim 4 wherein at least one of said dyes is selected from the group consisting of

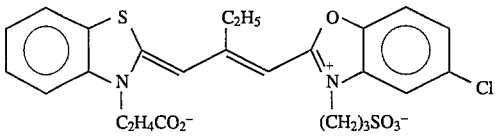

and

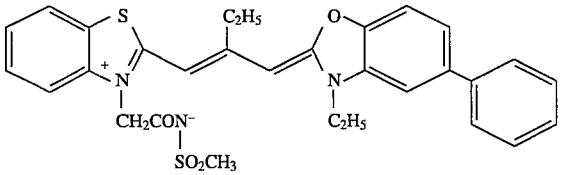

10. An emulsion comprising tabular silver bromoiodide grains said grains comprising sensitizing dyes and adsorbed onto said grains during grain forming or sensitizing at least one sulfodihydroxy aryl compound represented by the Formula I or Formula II

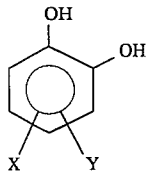

(Formula I)

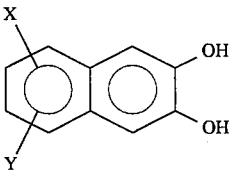

(Formula II)

wherein

X and Y represent an $SO_3$ group or a hydrogen atom with at least one of X and Y being a sulfo group wherein said dyes and sulfodihydroxy aryl compound are on the surface of said grains and said sensitizing dyes comprise

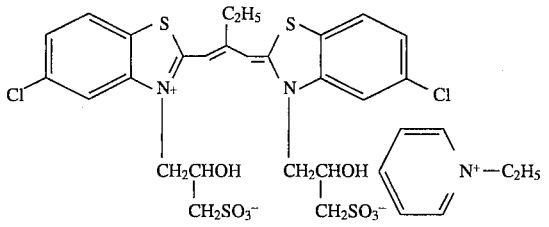
-continued
or
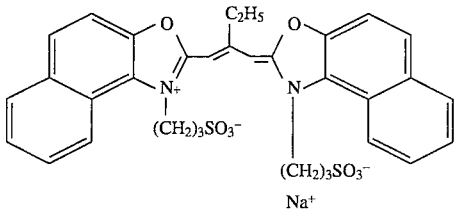
* * * * *